United States Patent [19]

Wagner

[11] Patent Number: 4,989,272

[45] Date of Patent: Feb. 5, 1991

[54] TROUSER CONSTRUCTION

[76] Inventor: Yitzhak Wagner, 13 Zerubavel Street, Haifa, Israel

[21] Appl. No.: 523,227

[22] Filed: May 14, 1990

[30] Foreign Application Priority Data

Mar. 18, 1990 [IL] Israel ..... 093784

[51] Int. Cl.[5] ..... A41D 1/06

[52] U.S. Cl. ..... 2/227; 2/238; 2/234; 2/243 B; 2/403

[58] Field of Search ..... 2/227, 234, 238, 403, 2/243 B, 214, 401, 408, 78 B, 78 D

[56] References Cited

U.S. PATENT DOCUMENTS

| | | | |
|---|---|---|---|
| 331,959 | 12/1885 | Goldsmith | 2/227 |
| 590,596 | 9/1897 | Scriven | 2/401 |
| 3,083,710 | 4/1963 | Rauser | 2/401 |
| 3,525,336 | 8/1970 | Wadman | 2/403 |
| 3,793,646 | 2/1974 | Tempelhof | 2/78 B |
| 4,091,466 | 5/1978 | Kearn | 2/227 |
| 4,215,685 | 8/1980 | Ibel | 2/227 |
| 4,392,259 | 7/1983 | Bredo | 2/227 |
| 4,586,199 | 5/1986 | Birring | 2/401 |

FOREIGN PATENT DOCUMENTS 0055554 11/1979 European Pat. Off. .

*Primary Examiner*—Werner H. Schroeder
*Assistant Examiner*—Gloria Hale
*Attorney, Agent, or Firm*—Frishauf, Holtz, Goodman & Woodward

[57] ABSTRACT

A pair of anatomically fitted trousers prevents friction and pressure onto the genitals by means of a triangular crotch panel (B) which is attached to the bottom edge of a rectangular abdominal belt portion (A). The abdominal belt portion extends downwards from a waistband (2) to the top of two front leg portions (3), and is on its both sides connected by seams 4 to two rear leg portions (1). The front leg portions (3) are shorter than the rear leg portions (1) and have angular tops, one side of which is connected to the crotch panel (B) by seams (7), while the other, horizontal side is connected to the abdominal front portion (A) by means of seams (9) which contain the openings for pockets (12).

11 Claims, 3 Drawing Sheets

TROUSER CONSTRUCTION

BACKGROUND OF THE INVENTION

The invention relates to trouser construction and more particularly to improvements in the construction of the crotch and front region. And it relates particularly to trousers of sporty cut tightly fitting to the body similar to JEANS while, at the same time, accomodating the male genitals without pressure and friction caused by proximity of the trouser fabric.

Conventional closely fitting trousers generally comprise two frontal leg portions and two rear leg portions interconnected by substantially vertical seams along the sides of the legs and a centered crotch and fly seam along the crotch and the perineum, all four parts being connected at their upper ends to a waistband by means of horizontal, circumferential seams. This construction is apt to cause stresses from the trousers fabric on the male genitals and to the appearance of folds in the frontal portion along the hip joints, as well as folds from the male genital bulge. It has been proved that pressure and heat developed due to friction without means of ventilation may cause reduced output of sperm until eventual total impotence of the male. Usually extra space is provided in one of the leg portions, off-centre left or right of the medial crotch seam for placing the medially suspended genitals along one of the thighs. However, this position of the genitals likewise creates unpleasant pressure, and it has been tried in the past to construct trousers, especially for men, which support the genitals in a cup-shaped panel in the front and the crotch of the trousers.

Among the many publications two were selected as closely approaching the solution of the problem:

1. European Pat. Publication No. 0 005 554 (IBEL) describes trousers constructed of four leg portions connected to a waistband, whereof the front portions contain a cut-out starting at a point near the anus, exposing perineum, genitals, pubic area and the lower abdominal area up to near the waist line; a combination crotch/front panel is inserted into the cut-out connecting the leg portions and acting like a supportive curved panel for the genitals and pubic area.
2. U.S. Pat. No. 4,392,259 (BREDO) describes trousers constructed of four leg portions connected to the waistband, whereof the front portions possess cutouts in triangular shape into which a triangular crotch piece is inserted. Although not specially mentioned in the specification, it is assumed that a fly is provided along its vertical centre line.

The main drawback of the two above designs is the esthetic appearance of the person wearing the trousers, as of the trousers as well.

Another drawback of the trouser construction shown in IBEL lies in the fact that the male genitals are held inside a "bag", whereby the material of the bag and of the leg portions form two overlapping layers, unnecessarily warming the genitals and causing friction along the upper seam.

It is the object of the present invention to overcome these drawbacks and to construct tight-fitting trousers shaped to accomodate the genitals without pressure or friction.

It is another object to present the image of the wearer with long legs, in spite of the low crotch, by constructing the cut and the seams of the trouser portions in a suitable manner so as to deceive the eye of the viewer.

It is another object to provide trousers with a static portion of material surrounding the genitals, in contradistinction to the present designs wherein the leg portions continuously rub along the genital portion.

Still another object is to provide trousers with ventilating means for the genitals.

SUMMARY OF THE INVENTION

In according with one aspect of the present invention a pair of anatomically fitted trousers with an improved construction of the crotch and genital region includes a waistband, two rear leg portions, two front leg portions, a substantially rectangular abdominal belt portion at least along the trousers' front and a triangular crotch panel, adjacent the bottom edge of the abdominal belt portion and with its bottom apex extending as far as the perineum region. The rear leg portions extend either up to the waist-band or to the abdominal belt portion if the latter encircles the entire waist portion, and are interconnected by a central seam along the buttocks and connected to the front leg portions by lateral seams along the outer leg parts. The front leg portions are shorter, each forming an angular top the inner side of which is connected by seams to the cooperating side of the triangular crotch portion substantially coexistent with the line of the respective hip joint, while the outer side is connected by seams to a part of the abdominal belt portion. Pockets are suitably provided in the rear leg portions and optionally have their openings either in portions of the lateral seams or of the seams attaching the front leg portions to other components of the trousers.

In a preferred embodiment of the trousers the triangular crotch panel constitutes an integral part of the abdominal belt portion; as an alternative it may be connected to it by a seam, while both crotch panel and abdominal belt portion preferably contain a vertical fly closed by a slide fastener or other closing means.

In another embodiment of the trousers the abdominal belt portion is shorter than the frontal part of the trousers and is replaced by lateral pocket pieces which extend between the rear leg portions and the abdominal belt portion and contain two pockets, each on one side, whilst the angular top of the front leg portions extend between the pocket pieces and the abdominal belt portion.

SHORT DESCRIPTION OF THE DRAWINGS

FIG. 1, is a front view of a first embodiment of the trousers including a crotch panel integral with an abdominal belt portion, FIG. 2 is a front view of a second embodiment of the trousers including a crotch panel composed of an upper part integral with the abdominal belt portion and a lower separate part connected to the upper part and to the leg portions, FIG. 3 is another embodiment of the trousers illustrated in FIG. 1 including overlapping parts of the crotch panel and of the leg portions, providing ventilating means, FIG. 4 is another embodiment of the anatomic trousers provided with integral abdominal belt and crotch portions and with oblique pocket openings, FIG. 5 is another embodiment of the trousers as shown in FIG. 4 including side pockets and overlapping parts of the leg portions and the abdominal belt portion, and FIG. 6 illustrates a variation of the embodiment shown in FIG. 1 including overlapping parts of the leg portions and the abdominal belt portion.

DETAILED DESCRIPTION OF THE DRAWINGS

Figure 1:
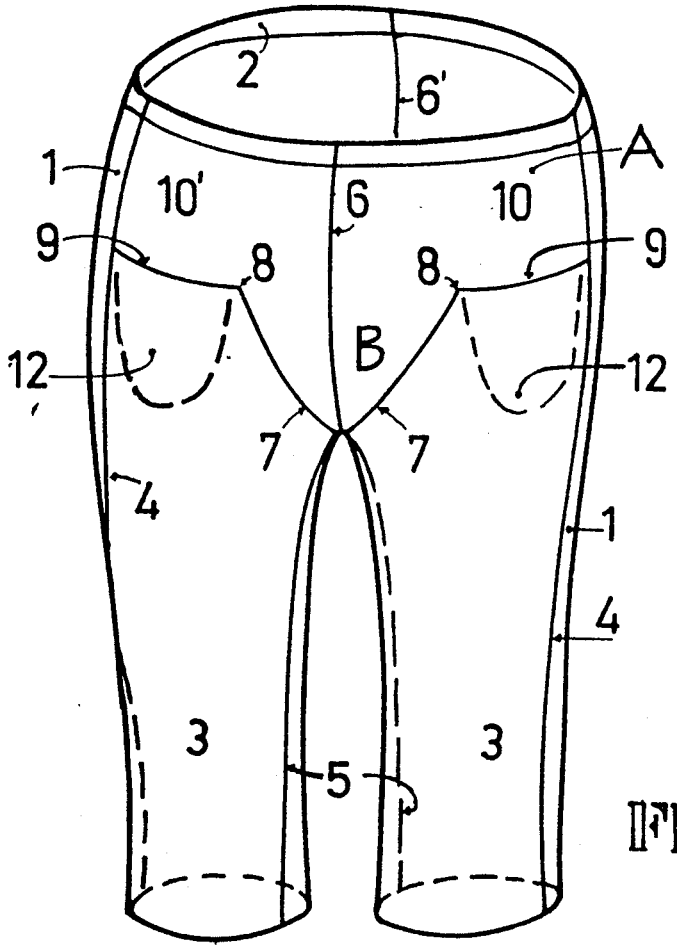
Figure 3:
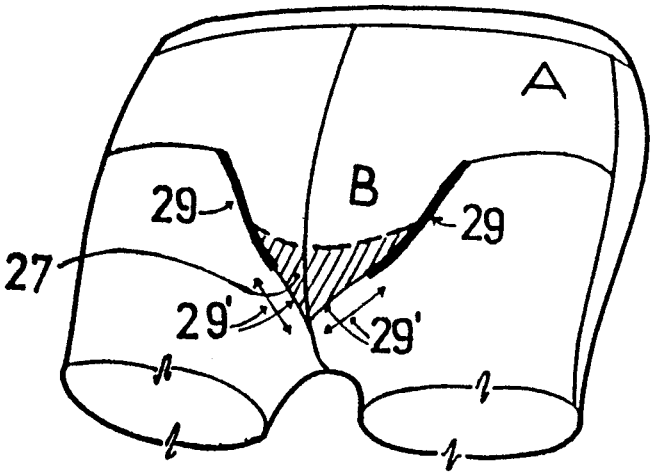

With reference to FIGS. 1 and 3 of the drawings a pair of trousers according to the present invention contains the following parts: a waistband 2, either encircling the entire circumference or constituting a part of the front and rear portions; a right and a left rear leg portion 1 extending from the waistband down to the heels and connected along the centre of the buttocks by a seam 6'; a right and a left front leg portion 3 connected to the rear leg portions 1 along outer seams 4 and inner seams 5; a substantially rectangular abdominal front portion A containing a triangular crotch panel B, either integral therewith as shown in the drawing, or attached by a seam; both the front-portion as well as the crotch panel are cut by a vertical seam 6 to be closed by a slide fastener or buttons, the right and left parts being designated by the numerals 10 and 10'. The abdominal front portion is attached to the waistband along its long top side, to the rear leg portions by the short vertical sides and to the front leg portions by horizontal seams 9—which may be relaced by pocket openings 12—and by oblique seams 7, thus forming the crotch panel, the seams meeting at points 8. Pockets 12 are shown—in broken lines—to extend downwardly from the horizontal connecting lines 9.

Figure 2:
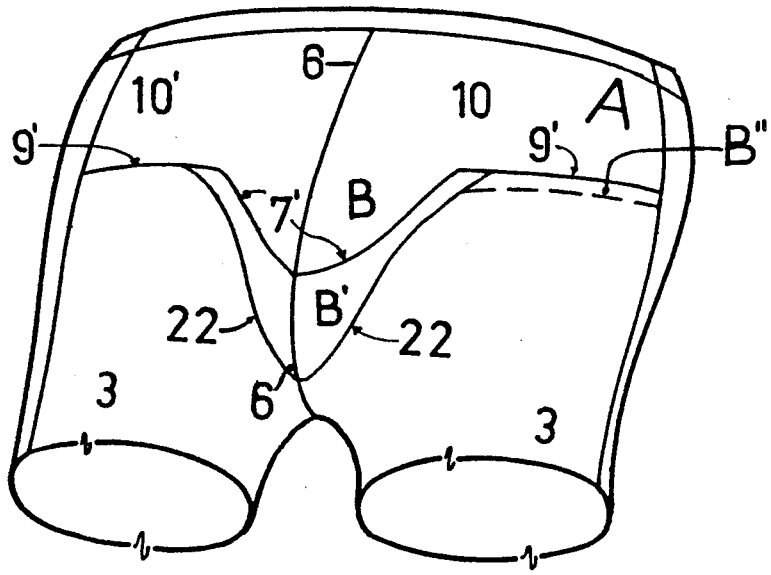

FIG. 2 shows essentially the same kind of trousers, with the difference that in the present embodiment the crotch panel is made up of two pieces of cloth: an upper triangular part B integral with the abdominal belt portion A and a lower part B' in butterfly shape which is attached to the front leg 3 portions by seams 22 and to the upper part by seams 7'. The lower part B' reaches down to the perineum and surrounds the genitals in a supporting and protecting manner. Both parts, or the upper part only, are generally slotted (6) and provided with closing means such as a slide fastener or buttons. Pockets are not shown, but may be provided similar to those shown in FIG. 1. In the present drawing front leg portions 3 are shown to be connected to the abdominal belt portion A by seams 9', but it is also proposed to extend the lower crotch panel B' to both sides by strips B'', as shown in broken lines. It is understood that this arrangement is for decorative purposes only, and has no effect on the support of the genitals.

FIG. 3 illustrates another embodiment of the trousers shown in FIG. 1: herein almost all parts are identical, except for the fact that the cut of the top part of the front leg portions is different, and that an upper sector of the leg portions is overlapped 27 by the lower part of the crotch panel. As indicated under 29' the seams 29 are not closed all the way, thus leaving an opening 29' for air circulation. The remaining parts are the same in both embodiments. As an alternative, the leg portions may overlap the lower part of the crotch panel, again with ventilation openings.

Figure 4:
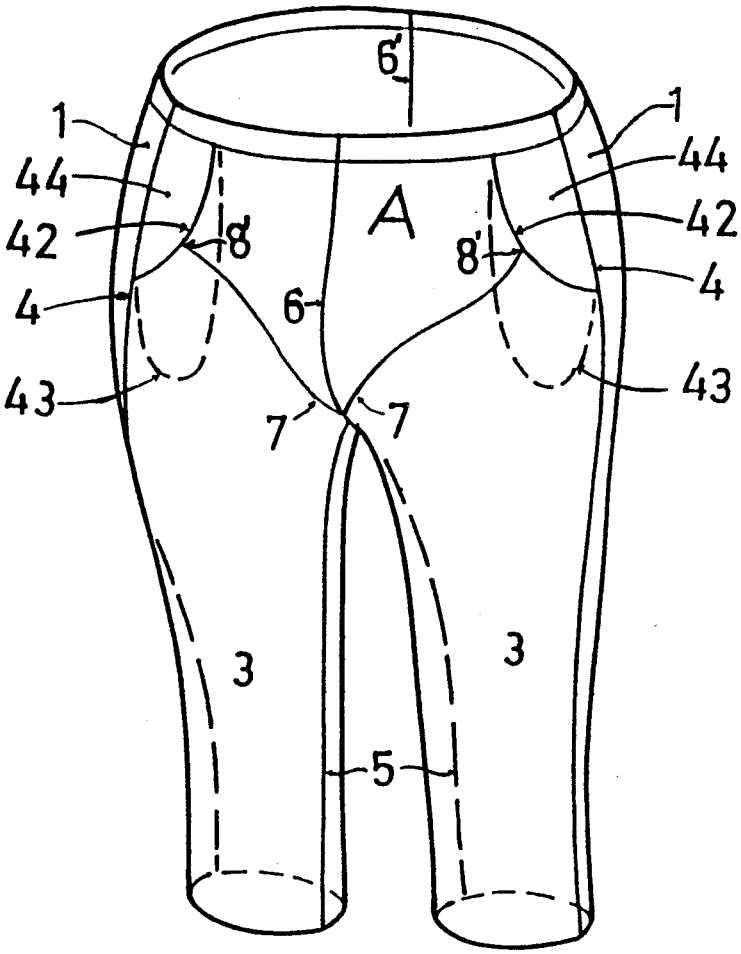

FIG. 4 illustrates a pair of trousers containing oblique pocket openings 42 and pockets 43. In this type of trousers the abdominal belt portion A stops short off the vertical seams 4 on both sides, and substantially triangular panels 44 are interpositioned between the front portion and the rear leg portions 1. In all other respects the cut of the trousers is identical with that of the trousers illustrated in FIG. 1, except for the front leg portions which form an acute angle in their tops. In addition, portion A and the tringular panels 44 may be cut of one piece of cloth which would, evidently somewhat shorten the pocket openings, i.e. they would extend from points 8' to the vertical seams 4.

Figure 5:
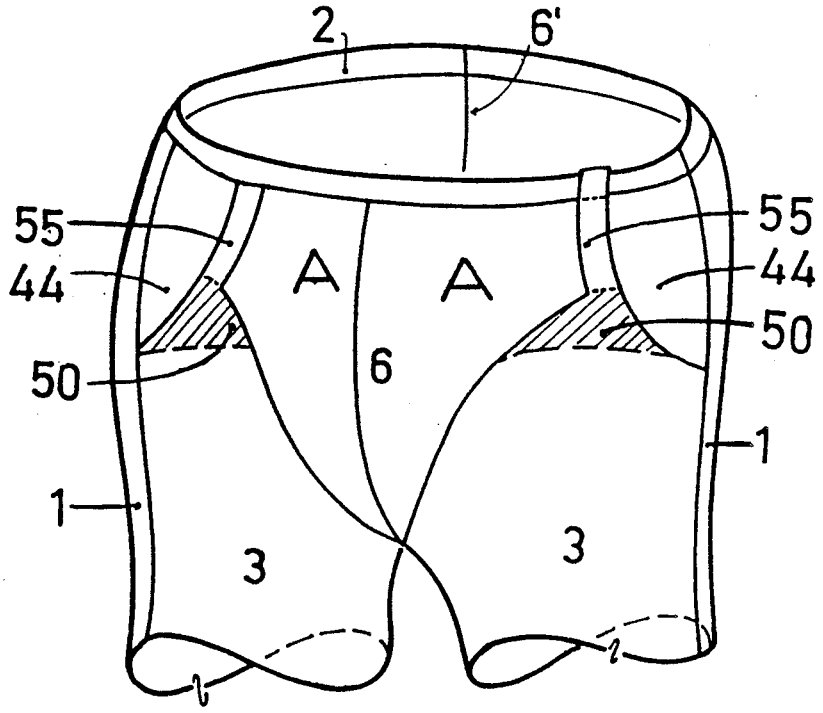

The trousers shown in FIG. 5 are almost identical with those of FIG. 4, but for decorative purposes vertical strips 55 are interposed or superposed between the side panels 44 and the front portion A. The latter is continued to the sides and can be overlapped by the tops of the leg portions as shown by shading 50, while the cut of the remaining parts is similar to the manner shown in FIG. 4.

Figure 6:
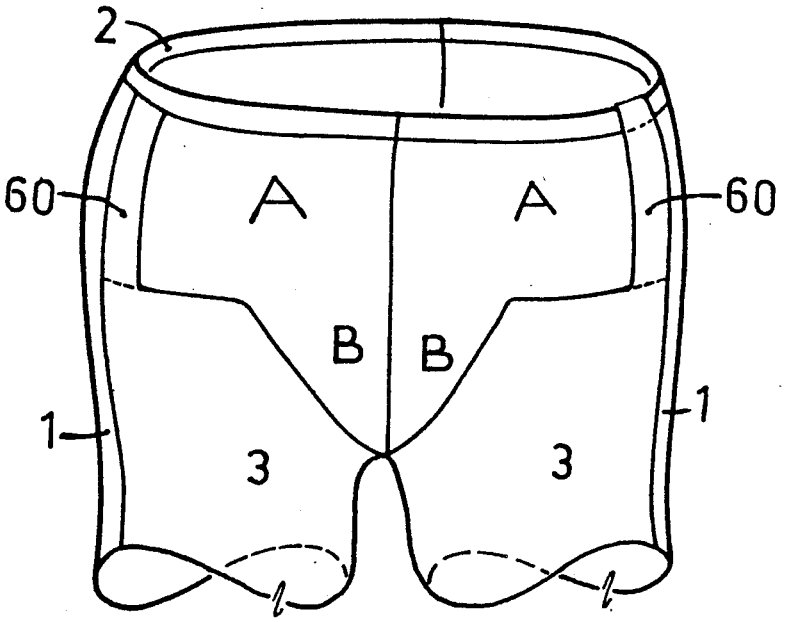

FIG. 6 shows again a cut similar to that of FIG. 1, but, again for decorative purposes, vertical strips 60 are interposed or superposed on the sides of the abdominal front portion A, thus connecting the upper ends of the front leg portions 3 with the waistband 2.

It will be understood that the embodiments shown in the accompanying drawings represent only several examples of the many possibilities of patterns, and that modifications and alterations may be carried out by a person skilled in the art, provided that they contain the distinctive portions, namely: (1) the abdominal belt portion and the crotch panel, which support the genitals while leaving them free from contact and rubbing with the front leg portions, during walking. (2) The seams along the hip joints which prevent unsightly creases in the trousers. (3) Frontal leg portions extending from their bottom ends to a distance below the waistband in the shape of angular top portions, to effect the impression of long legs in spite of the short inner length between the crotch panel and the bottom end. (5) The possibility to ventilate the genital region by slots provided along the triangular crotch portion.

What is claimed is:

1. A pair of anatomically fitted trousers serving to prevent friction or pressure onto the genitals while presenting the image of long legs of the wearer, comprising:

a waistband;

two rear leg portions interconnected along the buttocks by a central seam;

a substantially rectangular abdominal belt portion connected along the top thereof to said waistband and connected along sides thereof to said rear leg portions;

a substantially triangular crotch panel having a horizontal top side adjacent the bottom side of said abdominal belt portion and extending with a bottom apex thereof to the perineum region;

two front leg portions each having a top portion including a horizontal edge and a downwardly angled inner side edge portion, said inner side edge portion of said top portion being connected to a respective side edge of said triangular crotch panel by a seam substantially coexistent with a respective hip joint of the wearer, and a seam connecting said horizontal edge to said belt portion, the vertical sides of each said front leg portion being connected to the vertical sides of the respective said rear leg portion, along the leg outside and the leg inside respectively; and pockets extending from openings in any of the seams connecting the front leg portions with any of the other components of said trousers.

2. The pair of trousers as claimed in claim 1, wherein a part of said abdominal belt portion and of said crotch panel is provided with a vertical fly to be closed by closing means.

3. The pair of trousers as claimed in claim 1, wherein said crotch panel constitutes an integral part of said abdominal belt portion.

4. The pair of trousers as claimed in claim 1, wherein said crotch panel is a separate part attached to the bottom side of said abdominal belt portion by a seam.

5. The pair of trousers as claimed in claim l, wherein said crotch panel includes an upper, triangular portion and a lower portion in butterfly shape, said lower portion being connected to said top sides of the triangular tops of said front leg portions.

6. The pair of trousers as claimed in claim 1, wherein said pockets are provided in the front portion of said trousers, wherein the pocket openings are located in the seam connecting said front leg portions to said abdominal belt portion.

7. The pair of trousers as claimed in claim 1, wherein pocket openings are provided in said trousers in the seams connecting said abdominal belt portion to said rear leg portions.

8. The pair of trousers as claimed in claim 1, wherein the lower portion of said triangular crotch panel overlaps a part of the horizontal edge of said front leg portions, and wherein there remain open seams, permitting ventilation of the body parts covered by said crotch panel.

9. The pair of trousers as claimed in claim 1, wherein a part of the horizontal edge of said front leg portions overlaps the lower portion of said triangular crotch portion, and wherein there remain open seams, permitting ventilation of the body parts covered by said crotch panel.

10. The pair of trousers as claimed in claim 1, wherein substantially vertical strips connect the tops of said front leg portions with said waistband.

11. A pair of anatomically fitted trousers serving to prevent friction or pressure onto the genitals while presenting the image of long legs of the wearer, comprising:

a waistband;

two rear leg portions interconnected along the buttocks by a central seam;

a substantially rectangular abdominal belt portion connected along the top thereof to said waistband and connected along sides thereof to said rear leg portions;

a substantially triangular crotch panel having a horizontal top side adjacent the bottom side of said abdominal belt portion and extending with a bottom apex thereof to the perineum region;

two front leg portions each having a top portion including a downwardly angled outer side edge portion and a downwardly angled inner side edge portion, said inner side edge portion of said top portion being connected to a respective side edge of said triangular crotch panel by a seam substantially coexistent with a respective hip joint of the wearer, the outer side edge portion of said top portion being connected by a seam to the inner edge of a substantially triangular panel interposed between said abdominal belt portion and said rear leg portion, the vertical sides of each said front leg portion being connected to the vertical sides of the respective said rear leg portion, along the leg outside and the leg inside respectively; and pockets extending from openings in any of the seams connecting the front leg portions with any of the other components of said trousers.

* * * * *